US008884866B2

(12) United States Patent
Chen et al.

(10) Patent No.: US 8,884,866 B2
(45) Date of Patent: Nov. 11, 2014

(54) ELECTRONIC APPARATUS AND BACKLIGHT BRIGHTNESS CONTROL METHOD THEREOF

(75) Inventors: Li-Yin Chen, Taoyuan County (TW); Wen-Yueh Su, Taoyuan County (TW); Chun-Ta Lin, Taoyuan County (TW); Wei-Feng Chien, Taoyuan County (TW)

(73) Assignee: HTC Corporation, Taoyuan (TW)

( * ) Notice: Subject to any disclaimer, the term of this patent is extended or adjusted under 35 U.S.C. 154(b) by 540 days.

(21) Appl. No.: 12/902,663

(22) Filed: Oct. 12, 2010

(65) Prior Publication Data

US 2011/0134091 A1 Jun. 9, 2011

(30) Foreign Application Priority Data

Dec. 4, 2009 (TW) ..... 98141602 A

(51) Int. Cl.
*G09G 3/34* (2006.01)

(52) U.S. Cl.
CPC ..... *G09G 3/3406* (2013.01); *G09G 2320/064* (2013.01); *G09G 2360/144* (2013.01)
USPC ..... 345/102

(58) Field of Classification Search
USPC ..... 345/207, 173–184
See application file for complete search history.

(56) References Cited

U.S. PATENT DOCUMENTS

| | | | | |
|---|---|---|---|---|
| 4,752,771 | A * | 6/1988 | Katogi et al. | 345/88 |
| 5,617,112 | A * | 4/1997 | Yoshida et al. | 345/102 |
| 2007/0097065 | A1 * | 5/2007 | Kreek et al. | 345/102 |
| 2008/0165203 | A1 * | 7/2008 | Pantfoerder | 345/589 |
| 2010/0245310 | A1 * | 9/2010 | Hashimoto | 345/207 |

FOREIGN PATENT DOCUMENTS

WO WO-2009/0057527 A1 5/2009

* cited by examiner

*Primary Examiner* — Jason Olson
*Assistant Examiner* — Damon Treitler
(74) *Attorney, Agent, or Firm* — Rabin & Berdo, P.C.

(57) ABSTRACT

An electronic apparatus and a backlight brightness control method thereof are provided. The control method includes the following steps. Detection of an ambient brightness for the electronic apparatus is made to output an ambient brightness signal. Next, whether to adjust the backlight brightness for the display is determined according to a comparison between the ambient brightness signal and a current backlight brightness. If the comparison result indicates that the ambient brightness decrement is lower than a decrement threshold, then an adjustment value is selected from a plurality of step sizes according to the current backlight brightness to decrease the backlight brightness gradually, so that the backlight brightness changes towards a target backlight brightness corresponding to the ambient brightness signal. The step sizes include a first step size and a second step size. The backlight brightness for the display is adjusted according to the current backlight brightness and the adjustment value.

11 Claims, 3 Drawing Sheets

ELECTRONIC APPARATUS AND BACKLIGHT BRIGHTNESS CONTROL METHOD THEREOF

This application claims the benefit of Taiwan application Serial No. 98141602, filed Dec. 4, 2009, the subject matter of which is incorporated herein by reference.

BACKGROUND OF THE INVENTION

1. Field of the Invention

The invention relates in general to an electronic apparatus and a backlight brightness control method thereof, and more particularly to an electronic apparatus with stable backlight brightness and a backlight brightness control method thereof.

2. Description of the Related Art

With the rapid advance and universal popularity in telecommunication, electronic apparatuses, such as mobile phones, personal digital assistants (PDAs) and smart phones, have become indispensible electronic products to modern people in their everyday life. The electronic apparatus has a detection unit, such as a photo detector, for detecting the ambient brightness for the electronic apparatus to control the backlight brightness for a display of the electronic apparatus, not only providing appropriate backlight brightness according to the surrounding of the user but also reducing power consumption for the display.

In general, the detection unit is embedded at the peripheral of the electronic apparatus and is very sensitive to the change in the ambient light. That is, at the same surrounding (that is, the brightness does not change), when the electronic apparatus is shaken by the user, the signal detected by the detection unit will be affected by the incoming light angle of the detector, making the backlight brightness for the display unstable.

The electronic apparatus directly adjusts the backlight brightness for the display according to the signal provided by the detection unit. Due to the unstable detection the electronic apparatus being at a surrounding with diminishing ambient brightness, the user's eyes will being offended by the radical change in the backlight brightness for the display.

SUMMARY OF THE INVENTION

The invention is directed to an electronic apparatus and a backlight brightness control method thereof. An appropriate adjustment value is selected from a plurality of step sizes according to a brightness most convenient to the user's eyes to decrease the backlight brightness for a display gradually, lest the user may feel the eyes being offended by radical change in the backlight brightness for the display.

According to a first aspect of the present invention, a backlight brightness control method for adjusting the backlight brightness for a display of the electronic apparatus is provided. The method includes the following steps. Firstly, detection of the ambient brightness for the electronic apparatus is made to output an ambient brightness signal. Next, whether to adjust the backlight brightness for the display is determined according to the comparison between the ambient brightness signal and a current backlight brightness for the display. If the comparison result indicates that the ambient brightness decrement is lower than a decrement threshold, then an adjustment value is selected from a plurality of step sizes according to the current backlight brightness to decrease the backlight gradually, so that the backlight brightness changes towards a target backlight brightness corresponding to the ambient brightness signal. The step sizes include a first step size and a second step size, and the absolute values of the first step size and the second step size are different. The backlight brightness for the display is adjusted according to the current backlight brightness and the adjustment value.

According to a second aspect of the present invention, an electronic apparatus including a display, a detection unit and a processing unit is provided. The detection unit is for detecting the ambient brightness for the electronic apparatus to output an ambient brightness signal. The processing unit is used to compare an ambient brightness signal with a current backlight brightness for the display to determine whether to adjust the backlight brightness for the display. If the comparison result indicates that the ambient brightness decrement is lower than a decrement threshold, then an adjustment value is selected from a plurality of step sizes according to the current backlight brightness to decrease the backlight gradually, so that the backlight brightness changes towards a target backlight brightness corresponding to the ambient brightness signal. The processing unit further adjusts the backlight brightness for the display according to the current backlight brightness and the adjustment value. The step sizes include a first step size and a second step size, and the absolute values of the first step size and the second step size are different.

The above and other aspects of the invention will become apparent from the following detailed description of the preferred but non-limiting embodiments. The following description is made with reference to the accompanying drawings.

DETAILED DESCRIPTION OF THE INVENTION

Figure 1:
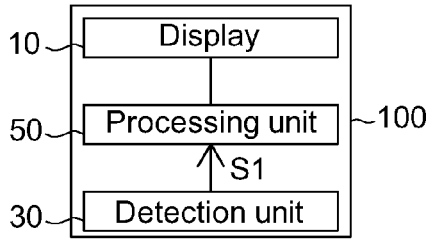
FIG. 1 shows an embodiment of an electronic apparatus using the backlight brightness control method.
Figure 2:
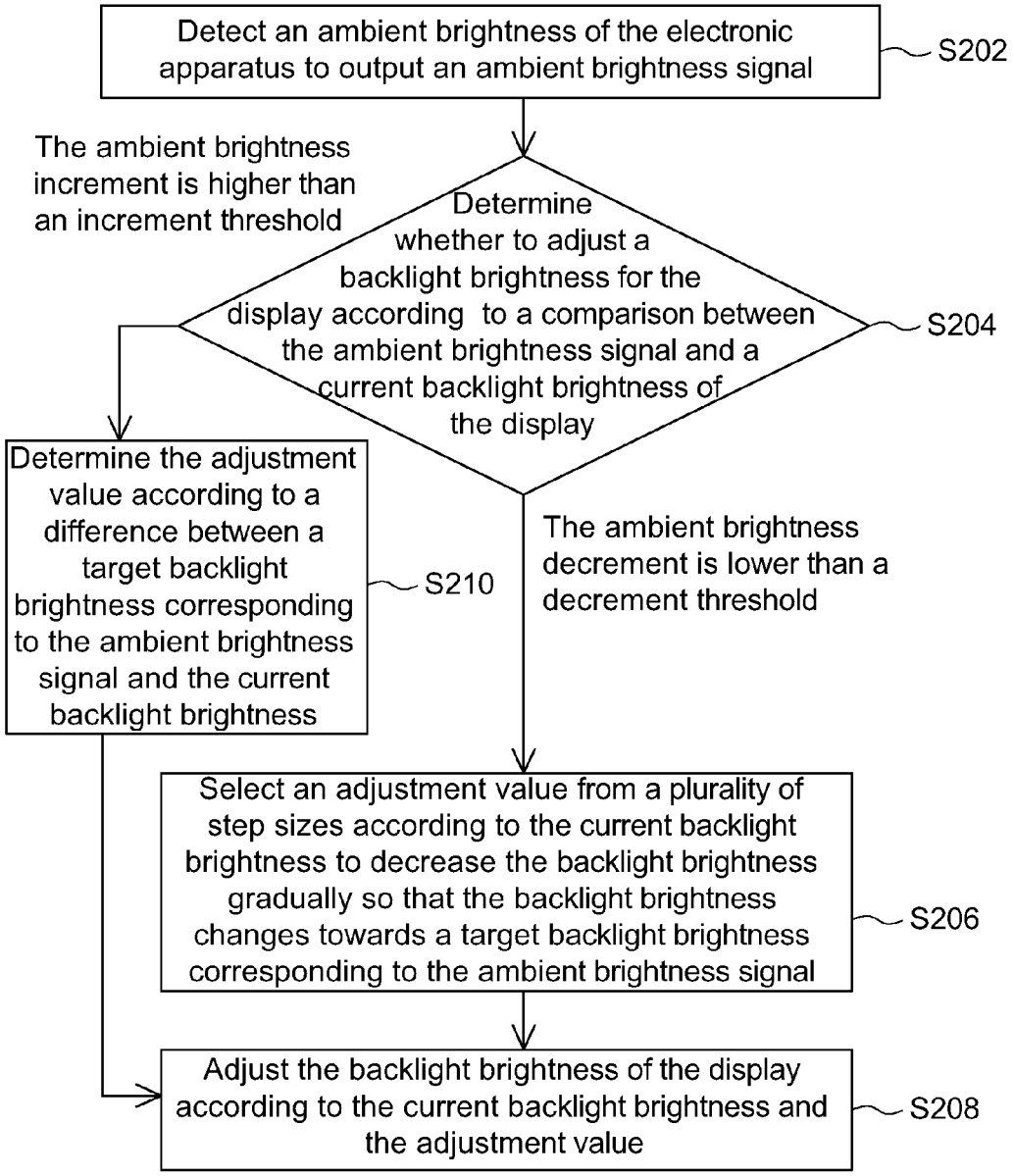
FIG. 2 shows a flowchart of a backlight brightness control method according to an embodiment of the invention.

Referring to FIG. 1 and FIG. 2, FIG. 1 shows an embodiment of an electronic apparatus using the backlight brightness control method. FIG. 2 shows a flowchart of a backlight brightness control method according to an embodiment of the invention. As indicated in FIG. 1, the electronic apparatus 100 includes a display 10, a detection unit 30 and a processing unit 50. The display 10 is such as a flat display with backlight. For example, the display 10 is a liquid crystal display using fluorescence or light emitting diodes for emitting the backlight. The detection unit 30 detects an optical signal, and further converts the optical signal into an electrical signal.

For example, the detection unit 30 detects an ambient brightness of the electronic apparatus 100, and further converts the detected optical signal into an electrical signal. In an embodiment, the detection unit 30 is exemplified by a photo detector. However, the detection unit 30 can also be replaced by other detectors capable of detecting brightness. The processing unit 50 determines whether to adjust the current backlight brightness according to the signal detected by the detection unit 30 and the current backlight brightness for the display.

For example, when people are exposed to the change in the ambient brightness, their eyes are more sensitive to the diminishing ambient brightness than the intensifying ambient brightness. When the electronic apparatus is exposed to a surrounding with diminishing ambient brightness, the present embodiment gradually decreases the backlight brightness for a display of the electronic apparatus according to a smaller step size, so that the user feels conformable and will not feel offended by the radical change in the backlight brightness when viewing the display. When the electronic apparatus is exposed to a surrounding with intensifying ambient brightness, since people's eyes are not so sensitive to the intensifying ambient brightness, the backlight brightness can be increased according to the difference between the ambient brightness and the backlight brightness for the display. However, the backlight brightness can also be increased by other methods. In the present embodiment, the difference between the ambient brightness and the backlight brightness for the display is used as the basis for adjusting the brightness, but is not for limiting the scope of the invention.

As indicated in FIG. 2, the backlight brightness control method is for adjusting the backlight brightness of the display 10 of the electronic apparatus 100. The method includes the following steps. Firstly, as shown in step S202, detection of the ambient brightness of the electronic apparatus 100 is made by the detection unit 30 to output an ambient brightness signal S1. Next, in step S204, whether to adjust the backlight brightness of the display 10 is determined by the processing unit 50 according to the comparison between the ambient brightness signal S1 and a current backlight brightness for the display 10.

Then, as indicated in step S206, if the comparison result indicates that the ambient brightness decrement is lower than a decrement threshold, then an adjustment value is selected from a plurality of step sizes according to the current backlight brightness to decrease the backlight gradually, so that the backlight brightness changes towards a target backlight brightness corresponding to the ambient brightness signal S1. If the comparison result indicates that the ambient brightness increment is higher than an increment threshold, then step S210 is performed. The step sizes include a first step size and a second step size, and the absolute values of the first step size and the second step size are different. In step S206, the backlight brightness is adjusted with diminishing ambient brightness.

After that, in step S208, the backlight brightness of the display 10 is adjusted by the processing unit 50 according to the current backlight brightness and the adjustment value. As indicated in step S210, the adjustment value is determined by the processing unit 50 according to a difference between a target backlight brightness corresponding to the ambient brightness signal and a current backlight brightness. In step S210, the backlight brightness is adjusted when the electronic apparatus is exposed to a surrounding with intensifying ambient brightness. The backlight brightness control method of FIG. 2 is exemplified below with a detailed flowchart.

Figure 3A:
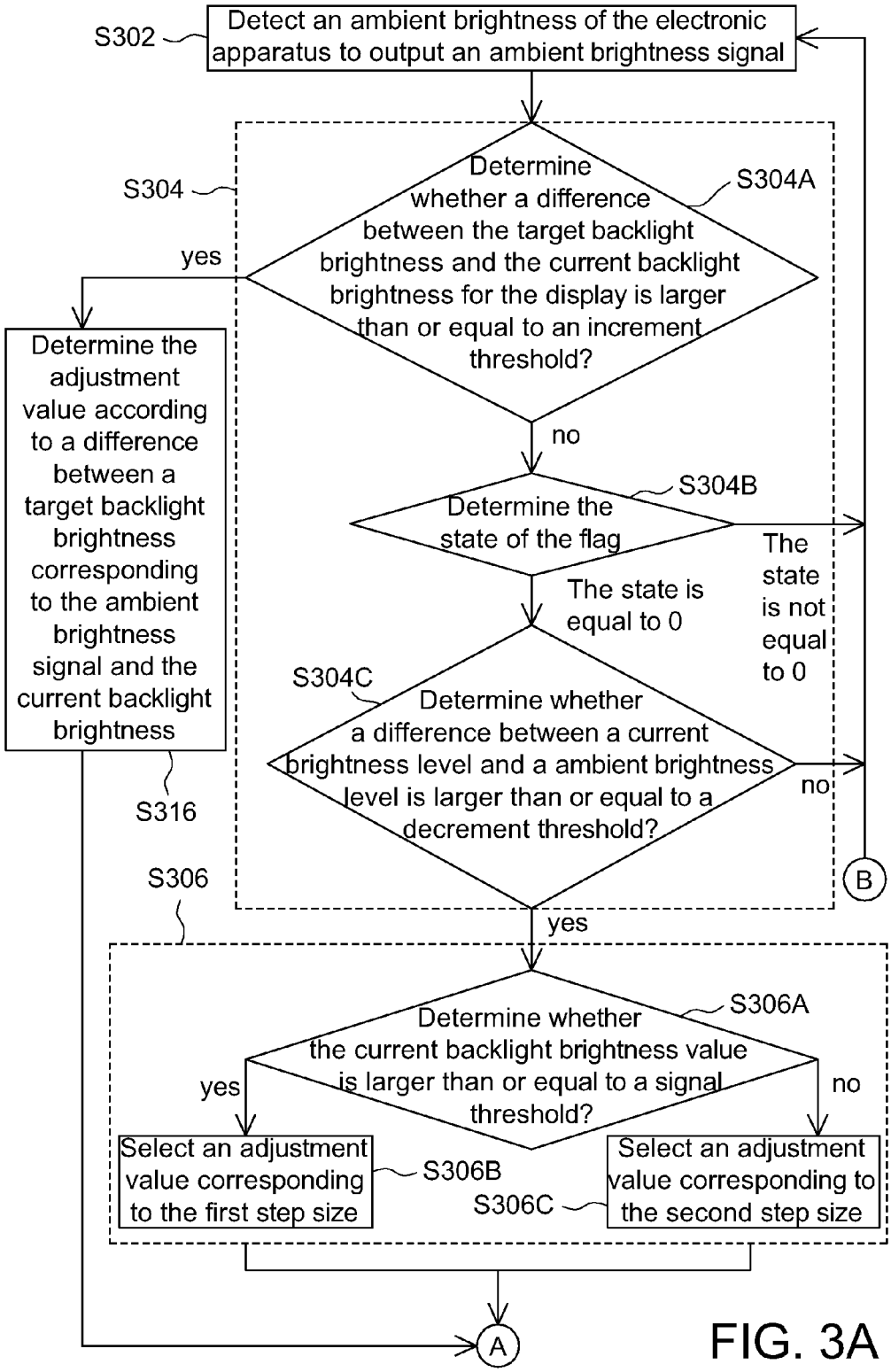
FIG. 3A shows a detailed flowchart of an example of an embodiment according to the backlight brightness control method of FIG. 2.
Figure 3B:
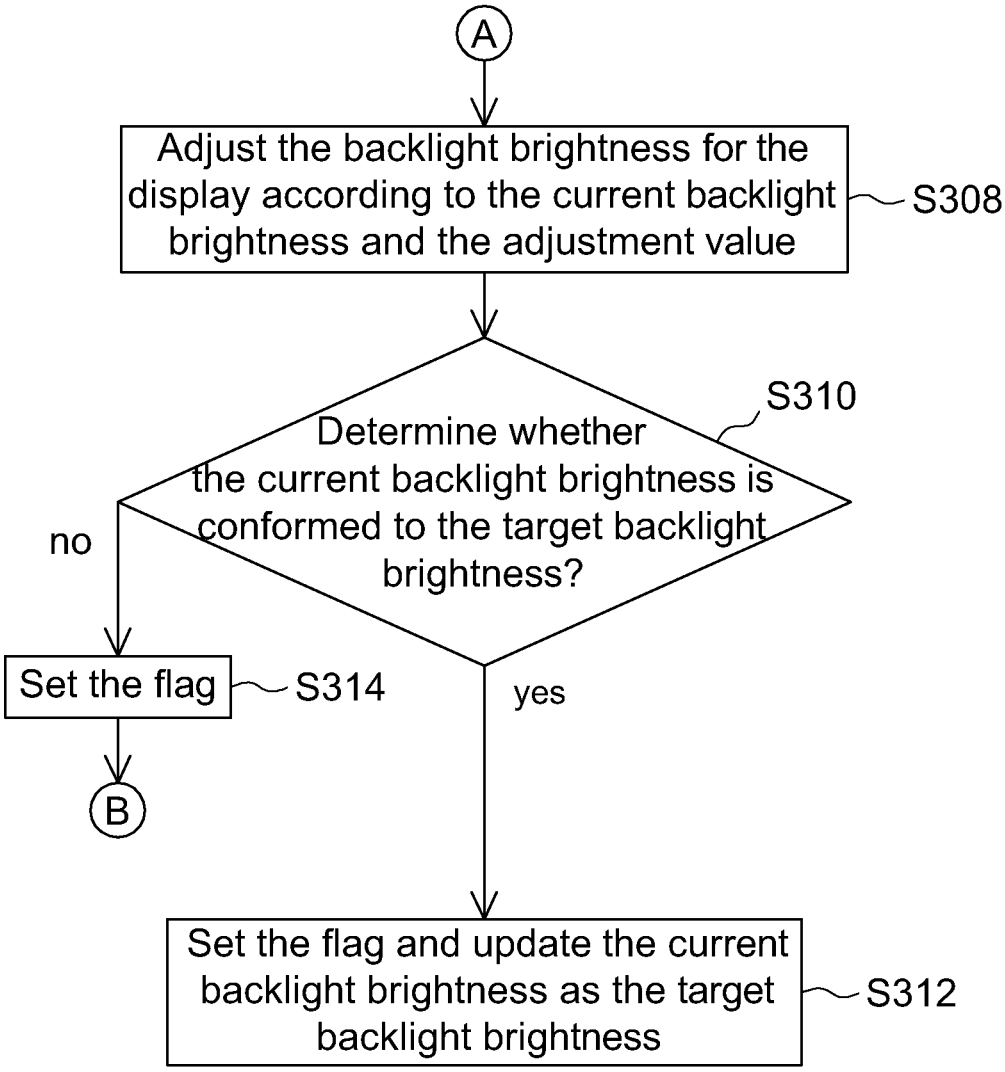
FIG. 3B shows a detailed flowchart of another example of an embodiment according to the backlight brightness control method of FIG. 2.

Referring to FIG. 3A and FIG. 3B, a detailed flowchart of an example of an embodiment according to the backlight brightness control method of FIG. 2 is shown. As indicated in FIG. 3A, the method proceeds to step S302, wherein detection of the ambient brightness of the electronic apparatus 100 is made by the detection unit 30 to output an ambient brightness signal S1. For example, the ambient brightness relatively changes according to the surrounding of the electronic apparatus 100. The ambient brightness when the electronic apparatus 100 is exposed under the sunlight is larger than the ambient brightness when the electronic apparatus 100 is at an indoor surrounding.

As shown in step S304, whether to adjust the backlight brightness of the display 10 is determined by the processing unit 50 according to the comparison between the ambient brightness signal S1 and a current backlight brightness for the display 10. The comparison between the ambient brightness signal S1 and the current backlight brightness for the display 10 can have different implementations. For example, the ambient brightness signal corresponds to a brightness level, which corresponds to the backlight brightness unit, so that the ambient brightness signal can be compared with the current backlight brightness for the display 10. Besides, the brightness level can also correspond to a target brightness signal such as a pulse width modulation (PWM) value. The current backlight brightness can also correspond to a current pulse modulation value. In some embodiments, either or both of the brightness level and the pulse modulation value can be used as a comparison unit.

For example, step S304 may further include steps S304A-S304C. In step S304A, whether the difference between the target backlight brightness and the current backlight brightness for the display 10 is larger than or equal to an increment threshold is determined by the processing unit 50. If the difference is not larger than or equal to the increment threshold, then the step S304B is performed for determining the state of a flag (such as determining whether the flag equals "0") by the processing unit 50. If the difference is larger than or equal to the increment threshold, then step S316 is performed.

Suppose the difference is not larger than or equal to the increment threshold. This implies that the electronic apparatus 100 is not in a case with intensifying ambient brightness. Meanwhile, whether to increase the current brightness is based on the determination the state of the flag. Suppose the state of the flag being "0" implies that the previous adjustment of the backlight brightness for the display 10 by the electronic apparatus 100 is over; meanwhile, the adjustment of the backlight brightness can be implemented. Suppose the state of the flag being "1" implies that the previous adjustment of the backlight brightness for the display 10 by the electronic apparatus 100 is not over yet, so the current brightness cannot be increased until the previous adjustment of the brightness is over. In an embodiment, when the electronic apparatus 100 is activated again, the default value of the state of the flag is set to such as "0". However, the increment threshold can be designed and adjusted according to actual needs. In an embodiment, the increment threshold can be designed according to the characteristics of human's eyes.

Then, the method proceeds to step S304C, wherein whether the difference between a current brightness level and the ambient brightness level is larger than or equal to the decrement threshold is determined by the processing unit 50 if the state of the flag in the step S304B is 0. If the state of the flag in step S304B is not equal to 0, then the method returns to step S302, wherein, the current brightness level corresponds to the current backlight brightness, and the ambient brightness level corresponds to the ambient brightness signal.

Suppose the difference is larger than or equal to a decrement threshold. This implies that the electronic apparatus 100 is in a case with diminishing ambient brightness. In an embodiment, the user may be using the electronic apparatus under the sunlight and is walking towards an indoor surrounding. After the user enters an indoor surrounding, due to the decrement in the ambient brightness, the backlight brightness for the display 10 of the electronic apparatus 100 can be decreased to a backlight brightness for the user to view the display normally, hence saving power consumption. In another embodiment, whether the difference between a current backlight brightness and the corresponding ambient brightness signal is larger than the decrement threshold in step S304C can be determined by the processing unit 50. In practical application, the decrement threshold corresponding to the brightness level or the brightness value can be selected according to actual needs.

However, when the user is in a case with diminishing ambient brightness, the present embodiment further includes the following steps to avoid the user's eyes being offended by the radical change in the backlight brightness. A plurality of step sizes is provided, and an appropriate step size can be selected according to the ambient brightness to gradually decrease the backlight brightness for the display 10, so that the user's eyes will not be offended and a stable backlight brightness for the display is obtained.

Next, the present embodiment proceeds to step S306; if the comparison result of step S304 indicates that the ambient brightness decrement is lower than a decrement threshold, then an adjustment value is selected from a plurality of step sizes according to the current backlight brightness to decrease the backlight gradually, so that the backlight brightness changes towards a target backlight brightness corresponding to the ambient brightness signal. The step sizes include a first step size and a second step size, and the absolute values of the first step size and the second step size are different.

For example, the step S306 further includes step S306A-S306C. As indicated in step S306A, whether the current backlight brightness is larger than or equal to a signal threshold is determined by the processing unit. If the current backlight brightness is larger than or equal to the signal threshold, then step S306B is performed for selecting an adjustment value corresponding to the first step size. If the current backlight brightness is not larger than or equal to the signal threshold, then the step S306C is performed for selecting an adjustment value corresponding to the second step size.

For example, the current backlight brightness corresponds to a current backlight brightness, which corresponds to a current pulse modulation signal. In other embodiments, the determination step can use either or both of the pulse modulation signal and the backlight brightness as a comparison unit. Detailed steps S306A~306B are disclosed below.

For example, when the user is in a case with diminishing ambient brightness, the user is more sensitive to the diminishing brightness of the display being viewed in addition to a particular range of brightness. Suppose the current backlight brightness is not larger than or equal to the signal threshold. This implies that the user's eyes are exposed to the particular range of brightness. Here, the present embodiment can gradually decrease the backlight brightness for the display according to smaller modulation values. In other words, an adjustment value corresponding to the first step size (such as smaller than the second brightness) is selected to decrease the backlight brightness to avoid the user's eyes being offended by radical change in brightness. In an embodiment, the absolute value of the adjustment value of the first step size is exemplified by 5. In practical application, the ratio of the pulse width modulation value corresponding to the adjustment value is expressed as:

$$V = \frac{X}{256} \times 100\%,$$

wherein V is the pulse width modulation value, which denotes the duty cycle of a corresponding pulse modulation signal, and X is an adjustment value ranging between 0-256.

Suppose the current backlight brightness is larger than or equal to the signal threshold. This implies that the user's eyes are not exposed to abovementioned particular range of brightness. That is, the user's eyes can feel radical change in the backlight brightness for the display 10 without greatly decreasing the backlight brightness. Thus, the backlight brightness for the display can be deceased at a larger modulation value. In other words, an adjustment value corresponding to the second step size is selected to decrease the backlight brightness. In an embodiment, the absolute value of the adjustment value of the second step size is such as 20, and the second step size is larger than the first step size. That is, suppose the decrement in the backlight brightness is a fixed range of brightness, to decrease the fixed brightness according to the adjustment value of the second step size is faster than to decrease the fixed brightness according to the adjustment value of the first step size.

In Step S306, a plurality of signal thresholds combined with a plurality of step sizes can be designed, so that an adjustment value can be selected according to the ambient brightness to adjust the backlight brightness for the display. In the present embodiment, one signal threshold is combined with a first step size and a second step size, but the invention is not limited thereto. In another embodiment, two signal thresholds are combined with three different step sizes in the selection of the adjustment value.

Next, the method proceeds to step S308; as indicated in FIG. 3B, the backlight brightness for the display is adjusted according to the current backlight brightness and the adjustment value. Thus, when the user views the display with intensifying ambient brightness, the user's eyes will not be offended by the radical change of diminishing backlight brightness, and power consumption is reduced.

Then, the method proceeds to step S310, whether the current backlight brightness is conformed to a target backlight brightness is determined. If the current backlight brightness is conformed to the target backlight brightness, then step S312 is performed by the processing unit 50 for setting the flag (for example, the flag being "0" implies the adjustment of the backlight brightness is completed) and updating the current backlight brightness as a target backlight brightness. If the current backlight brightness is not conformed to the target backlight brightness, then step S314 is performed by the processing unit 50 for setting the flag (for example, the flag being "1" implies the adjustment of the backlight brightness is not completed) and step S302 is repeated until the current brightness is conformed to the target brightness. In addition, the target backlight brightness which has been updated can be used in the next cycle.

For example, after step S312 is completed, subsequent steps can be designed according to actual needs. In an embodiment, after step S312 is completed, the method returns to step S302, and detection of the ambient brightness is implemented.

Referring to step S304A. If the difference between a current backlight brightness and a target backlight brightness is larger than or equal to an increment threshold, then step S316 is performed. Then, the method proceeds to step S316; the adjustment value is determined by the processing unit 50 according to a difference between a target backlight brightness corresponding to the ambient brightness signal and a current backlight brightness. For example, since the user's eyes are not sensitive to the change of an intensifying ambient brightness, the present embodiment uses the difference as an adjustment value for increasing the current backlight brightness. However, the adjustment value can be adjusted or designed according to actual needs.

In another embodiment, the correspondence between the ambient brightness signal and the ambient brightness level can be dynamically adjusted, and so can the decrement threshold in step S304C or even the increment threshold be dynamically adjusted. That is, the brightness of the display can be delicately determined according to the ambient brightness of the electronic apparatus 100.

For example, the correspondence relations of the brightness levels can be designed according to the change range of the ambient brightness. That is, a particular range of brightness (such as 100~200) can be obtained from the ambient brightness corresponding to many surroundings (such as indoors and outdoors) within a certain period of time (such as 1 minute). Thus, the current surrounding can be determined as an indoor surrounding and the correspondence relation BL1 of a brightness level can be defined. If the brightness obtained within 1 minute ranges between 110 and 300, then the current surrounding can be determined as an outdoor surrounding and the correspondence relation BL2 of another brightness level can be defined. In an embodiment, when the brightness detected indoors is 200, the corresponding brightness level is 180 according to the correspondence relation BL1. In contrast, for the brightness detected outdoors of 200, the corresponding brightness level is 200 according to the correspondence relation BL2. In other embodiments, the brightness level or other corresponding thresholds can be designed or adjusted according to actual needs, and the correspondence relations of the brightness levels can be stored in the electronic apparatus 100 or implemented as a look-up table from which corresponding brightness values can be obtained. The implementations can be done in different manners, and are not limited to the above exemplification.

Thus, the way of converting the obtained brightness signal or brightness value into brightness level simplifies the complexity in implementation. However, step S304 can also be implemented according to the ambient brightness signal and the signal corresponding to the current backlight brightness, but is not limited to the exemplification of the present embodiment.

In other embodiments of application, the average value of the ambient brightness signal can be obtained by averaging the obtained brightness values and filtering the noise. Suppose the user shakes the electronic apparatus, so that noise occurs to the ambient brightness signal detected by detection unit 30, wherein the noise corresponds to the span of the rapid rise or fall of the ambient brightness signal. For example, the electronic apparatus is shaken at the surrounding with the same brightness. In the present embodiment, the noise generated within a predetermined period of time can be filtered by averaging the ambient brightness signal, and the filtering process can be implemented by hardware or software. However, the averaging process can be implemented by other computation methods or hardware. In another embodiment, the ambient brightness signal can be repeatedly averaged so that the ambient brightness signal can be obtained with higher accuracy.

According to the electronic apparatus and the backlight brightness control method disclosed in the embodiments of the invention, the backlight brightness for the display of the electronic apparatus is adjusted according to the ambient brightness so that power consumption is saved. Also, the backlight brightness is decreased by selecting appropriate step size according to the ambient brightness, so that the user will not feel the radical change in the backlight brightness when the user is in a case with diminishing ambient brightness. In addition, the backlight brightness for the display is stable.

While the invention has been described by way of examples and in terms of preferred embodiments, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A backlight brightness control method for adjusting a backlight brightness for a display of an electronic apparatus, wherein the method comprises:

(a) detecting an ambient brightness of the electronic apparatus to output an ambient brightness signal;

(b) determining whether to adjust the backlight brightness for the display according to a comparison between a target brightness and a current backlight brightness of the display;

(c) selecting an adjustment value if the result of the comparison in step (b) is that the backlight brightness should be adjusted, wherein the adjustment value is selected from a plurality of step sizes in order to decrease the backlight brightness gradually if the comparison result of step (b) indicates that the difference between the current backlight brightness and the ambient brightness is at least as large as a decrement threshold, so that the backlight brightness is reduced gradually towards a target backlight brightness, a first step size being selected as the adjustment value if the current backlight brightness is at least as large as a signal threshold and a second step size being thereafter selected as the adjustment value when the current backlight brightness level is smaller than the signal threshold, the absolute values of the first step size and the second step size being different, and wherein the adjustment value is selected according to a difference between the target backlight brightness and the current backlight brightness if the comparison result of step (b) indicates that the ambient backlight brightness has risen above an increment threshold, and (d) adjusting the backlight brightness of the display according to the current backlight brightness and the adjustment value, wherein the first step size is used to decrease the pulse width of a PWM drive signal for a backlight of the display one or more times until the current backlight brightness is smaller than a signal threshold and the second step size is used to decrease the pulse width of the PWM drive signal one or more times until the current backlight brightness becomes smaller than the decrement threshold.

2. The method according to claim 1, wherein the amount ambient brightness reduction, if the result of step (b) indicates that the difference between the current backlight brightness and the target brightness has fallen to the level lower than the decrement threshold, is determined according to the target brightness and the current backlight brightness, the ambient backlight brightness corresponding to the current backlight brightness except when step (d) is being conducted.

3. The method according to claim 2, wherein the ambient brightness reduction is substantially a difference between a brightness value corresponding to the ambient brightness signal and the current backlight brightness value.

4. The method according to claim 1, wherein the absolute value of the adjustment value corresponding to the first step size is larger than the absolute value of the adjustment value corresponding to the second step size.

5. The method according to claim 1, further comprising:

determining whether the current backlight brightness conforms to the target backlight brightness while step (d) is being conducted; and updating the current backlight brightness to the target backlight brightness after step (d) is completed.

6. An electronic apparatus, comprising:

a display;

a detection unit for detecting an ambient brightness of the electronic apparatus to output an ambient brightness signal; and a processing unit for determining whether to adjust the backlight brightness for the display according to the comparison between a target backlight brightness and a current backlight brightness for the display and for adjusting the backlight brightness accordingly, wherein if the comparison result of the processing unit indicates that the difference between the current backlight brightness and the ambient brightness has fallen to a level lower than a decrement threshold, then an adjustment value is selected from a plurality of different step sizes in order to decrease the backlight brightness gradually towards a target backlight brightness, a first step size being selected as the adjustment value if the current backlight brightness is at least as large as a signal threshold, the first step size being used to decrease the pulse width of a PWM drive signal for a backlight of the display one or more times until the current backlight brightness is smaller than the signal threshold, wherein if the comparison result of the processing unit indicates that the difference between the target backlight brightness and the current backlight brightness has risen to a level higher than an increment threshold, then the adjustment value is determined according to the target backlight brightness and the current backlight brightness.

7. The electronic apparatus according to claim 6, wherein the amount of ambient brightness reduction, if the difference between the target backlight brightness and the current backlight brightness has fallen to level lower than the decrement threshold, is determined according to the target backlight brightness and the current backlight brightness, the ambient brightness corresponding to the current backlight brightness except while the backlight brightness is being adjusted.

8. The electronic apparatus according to claim 7, wherein the backlight brightness reduction is substantially a difference between a brightness value corresponding to the ambient brightness and the current backlight brightness.

9. The electronic apparatus according to claim 6, wherein if the comparison result of the processing unit indicates that the difference between the target backlight brightness and the current brightness is at least as large as the decrement threshold and that the current backlight brightness has fallen to a level lower than the signal threshold, then a second step size is selected as the adjustment value, the second step size being used to decrease the pulse width of the PWM drive signal one or more times until the difference between the target backlight brightness and the current backlight brightness becomes smaller than the decrement threshold.

10. The electronic apparatus according to claim 6, wherein the processing unit is used to determine whether the current backlight brightness conforms to the target backlight brightness, and further updates the current backlight brightness to the target backlight brightness if the current backlight brightness conforms to the target backlight brightness after the backlight brightness has been adjusted.

11. The electronic apparatus according to claim 9, wherein the absolute value of the first step size is larger than the absolute value of the second step size.

* * * * *